US006430971B1

(12) United States Patent
Kaylan et al.

(10) Patent No.: US 6,430,971 B1
(45) Date of Patent: Aug. 13, 2002

(54) SPHERICAL SURFACE DRIVE BLOCK FOR WASHING MACHINE BASKET

(75) Inventors: Ali Kaylan, St. Joseph; James R. Ollis; Eric K. Farrington, both of Stevensville, all of MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/571,341

(22) Filed: May 16, 2000

(51) Int. Cl.[7] ..... D06F 37/40
(52) U.S. Cl. ..... 68/23.7; 68/133
(58) Field of Search ..... 68/23.6, 23.7, 68/133

(56) References Cited

U.S. PATENT DOCUMENTS

| | | | | |
|---|---|---|---|---|
| 3,598,460 A | 8/1971 | Courath | 308/238 |
| 3,845,642 A | 11/1974 | Cochran | 68/23.7 |
| 3,922,891 A | 12/1975 | Sundstrom, Jr. | 68/23.3 |
| 3,922,892 A | 12/1975 | Bochan | 210/364 |
| 4,000,631 A | 1/1977 | Drews et al. | 68/23.7 |
| 4,250,724 A | 2/1981 | Altnau | 68/23.2 |
| 4,563,786 A | 1/1986 | Brunswick et al. | 8/159 |
| 5,117,658 A | 6/1992 | Bisplinghoff et al. | 68/23.3 |
| 5,249,440 A | 10/1993 | Hossfield et al. | 68/23.3 |
| 5,257,516 A | 11/1993 | Hossfield | 68/23.3 |
| 5,823,068 A | 10/1998 | Burgers | 74/574 |

FOREIGN PATENT DOCUMENTS

| | | | |
|---|---|---|---|
| EP | 230261 B1 | 12/1991 | A01D/41/12 |
| EP | 491576 B1 | 6/1992 | D06F/15/00 |
| EP | 620308 B1 | 10/1994 | D06F/15/00 |

*Primary Examiner*—Philip Coe
(74) *Attorney, Agent, or Firm*—Robert O. Rice; Thomas J. Roth; Andrea Powers Denklau

(57) ABSTRACT

A wash basket alignment system for an automatic washing machine having a wash basket with a drive block partially inserted through a central aperture in the bottom wall of the wash plate. A spin drive tube extends longitudinally through the central aperture in the drive block and through the wash plate bottom wall. A hold down nut is threadingly engaged to the drive block from the inside chamber of the wash basket to position the wash basket within the wash tub. Concentric alignment of the wash basket along a central longitudinal axis decreases basket runout. Therefore, the drive block has a spherical outside surface where it abuts the conical shaped outer surface of the wash basket. The radius of the spherical outside surface intersects the central axis at a point. This configuration facilitates the sliding or moving of this juncture from a first position out of concentricity to a second position that is concentric about the longitudinal axis. Additionally, the hold down nut has a conical shaped underside surface where it abuts the spherical shaped inner surface of the wash basket. A normal taken at this abutment passes through the same point on the central axis. This configuration facilitates movement from a first position out of concentricity to a second position with the wash basket concentric about the longitudinal axis. These two junctures are maintained by tightening the hold down nut.

27 Claims, 5 Drawing Sheets

SPHERICAL SURFACE DRIVE BLOCK FOR WASHING MACHINE BASKET

BACKGROUND OF THE INVENTION

1. Field of the Invention

The present invention relates to a washing machine and more particularly, to a system for aligning a wash basket concentrically about the rotational axis of the basket in a manner that decreases runout.

2. Description of Related Art

Typically, a conventional vertical axis automatic washer has a tub and a wash basket vertically aligned within the tub. A drive block supports the wash basket and a spin drive tube extends longitudinally through apertures positioned centrally within the wash basket and drive block. The spin drive tube is driven by a motor that operates the spinning action of the wash basket. It is desired to have the wash basket concentric about a central axis extending the length of the spin drive tube to reduce wash basket runout during the spin cycle.

Conventional automatic washers have at least a wash and spin cycle. During the spin cycle, the spin drive tube drives the wash basket in a spinning motion to force wash liquid out of the wash basket and clothes. The wash basket may be spinning at a rate of 600 to 1000 rpm so it is important that the wash basket is aligned with the central axis or it will become out of balance and wobble or vibrate. When the wash basket becomes out of balance, it may hit the side of the wash tub causing noises. In extreme out of balance situations, the movement of the wash basket hitting the wash tub may cause the washer to "walk". Additionally, since there is a current trend for higher wash basket capacity without an increase in the size of the cabinet frame, it is necessary to have lower tolerances to maintain control over the basket clearance.

In an automatic washer having a drive block supporting the wash basket, a portion of the drive block is inserted through a central aperture in the bottom of the wash basket and the wash basket bottom surface rests on another portion of the drive block. The spin drive tube extends through a central aperture in the drive block and in the wash basket bottom. The wash basket is fixed in position by a hold down nut that is threaded to the drive block inside the wash basket area or it may be fixed in position by one or more threaded fasteners. Therefore, if the wash basket is not aligned properly on the drive block, it will not be concentric about the central axis. Also, if the drive block is not aligned properly about the central axis, then the wash basket may not be concentric. So, it is important to have the overall alignment system of both the drive block and wash basket to provide a concentric spinning of the wash basket.

Traditional drive blocks are generally conical in shape and contact the generally conical outside surface of the wash basket bottom. Thus, the drive block and the wash basket abut circumferentially along a generally planar, conical surface. It is appreciated that there is basically one position in which the drive block and wash basket surfaces actually abut, but there are multiple possible positions for the drive block and wash basket to abut. Therefore, both the drive block and wash basket must be concentric about the central axis to obtain an accurate position.

Typically, the manufacturing process of an automatic washer includes the steps of configuring the drive block, spin drive tube, wash basket and hold down nut as close to concentric as possible. Acceptable tolerances for alignment about a central axis are determined for each step of the process; therefore, the tolerances stack up with each step. There would be better alignment about the central axis if the system of aligning the drive block and wash basket was done relative to each other to ensure overall concentricity of the spinning wash basket.

SUMMARY OF THE INVENTION

The present invention is directed to a system of aligning the wash basket of a washing machine concentrically about a central axis to decrease basket run out. The wash basket alignment system has a wash basket with a bottom wall having an outer surface and an inner surface, and a spin drive tube extending longitudinally along a generally central axis and through a central aperture in the basket bottom wall. Further, a rim defines the bottom wall central aperture and a wash basket center portion extends outward from the rim. The center portion is generally spherical in shape along the bottom wall inner surface. The wash basket has a mating portion extending outward from the center portion that is generally conical in shape along the bottom wall outer surface. There is a drive block having an upper portion with a central aperture for receiving the spin drive tube, a middle portion having a generally spherical shaped outside surface, and a threaded portion positioned between the upper portion and the middle portion.

It is an object of the invention to provide a wash basket alignment system wherein the drive block middle portion outside surface and the wash basket mating portion outer surface abut at a mating juncture when the drive block upper portion and threaded portion are inserted through the wash basket central aperture. The mating juncture is generally the circumference of a circle or ellipse.

Further, it is an object of the invention to provide a hold down nut having threads and a generally conical shaped underside surface with the threads mating with the drive block threaded portion. Additionally, the hold down nut underside surface and the wash basket center portion inner surface abut at a second juncture when the hold down nut threads are threadingly engaged with the drive block threaded portion. The second juncture is generally the circumference of a circle or ellipse.

It is an object of the invention to provide a hold down nut having threads and a generally conical underside surface with the hold down nut positioning the wash basket rim and central portion between the hold down nut and drive block middle portion when the hold down nut is threadingly engaged with the drive block threaded portion.

It is a further object of the invention to provide a hold down nut to position the mating portion outer surface with the drive block middle portion outside surface when the hold down nut is threadingly engaged with the drive block threaded portion. A circumferentially shaped mating juncture is formed that moves from a first position when the wash basket is not concentrically aligned about the central axis to a second position when the wash basket is concentrically aligned about the central axis.

Further, it is an object of the invention to provide a second juncture at which the wash basket center portion abuts the hold down nut conical shaped underside surface when the hold down nut threads threadingly engage the drive block threaded portion.

It is a further object of the invention to provide a mating juncture that may be shifted from a first position where the wash basket is not concentric about the central axis to a second position where the wash basket is generally concentric about the central axis, then the hold down nut can be threaded to the drive block threaded portion to maintain the second position. Further, the second juncture is shifted from a first position to a second position when the mating juncture is shifted from its first position to its second position and the second juncture second position is maintained by tightening the hold down nut to the drive block threaded portion.

It is a further object of the invention to provide a method of concentrically aligning a wash basket in an automatic washer having a spin drive tube extending longitudinally through a central aperture in the wash basket and a central aperture in a hold down nut and a central aperture in a drive block by positioning the wash basket aperture along a longitudinal axis, positioning the drive block aperture along the longitudinal axis, inserting a generally cylindrical portion of the drive block into the aperture of the wash basket thus having a portion of the drive block positioned within an interior area of the wash basket, resting an outer bottom surface of the wash basket on an outside surface of the drive block, threadingly engaging the hold down nut with mating threads on the drive block positioned in the interior area of the wash basket, spinning the wash basket along the longitudinal axis to determine concentricity of the wash basket, measuring concentricity of the wash basket along the longitudinal axis, aligning the wash basket along the longitudinal axis in response to the concentricity measurement, and tightening the threaded engagement of the lock nut to maintain the position of the wash basket.

It is also an object of the invention to provide a wash basket alignment system for an automatic washing machine having a wash basket with a bottom wall having an outer surface and an inner surface; a drive block with a middle portion having a generally spherical outside surface; and a generally central axis extending though a central aperture in the bottom wall and in the drive block. The drive block has a radius measured from a point on the central axis. The wash basket rim defines the wash basket central aperture, the wash basket center portion extends outward from the rim and is generally either spherical shaped or conical shaped. If the center portion is spherical shaped, it has a radius that intersects the central axis at a point.

It is an object of the invention to have the drive block point and the center portion point intersect the central axis at a common point when the center portion is spherical shaped.

Further, it is an object of the invention to provide a wash basket alignment system having a wash basket mating portion extending outward from the center portion that is either conical in shape or spherical in shape along the bottom wall outer surface. If the center portion is conical, a mating juncture is formed by the drive block middle portion and the mating portion such that a normal of the mating portion taken at the mating juncture passes through the drive block point. If the center portion is spherical, a mating juncture is formed by the mating portion and the drive bock middle portion such that the mating juncture is generally at a distance from the drive block point equal to the drive block radius.

It is also an object of the invention to provide a hold down nut having either a generally conical or convex underside surface, and a juncture formed by the center portion inner surface and the hold down nut underside surface. If the underside is conical then a normal of the hold down nut underside surface taken at the juncture passes through the drive block point.

DESCRIPTION OF THE PREFERRED EMBODIMENT

Figure 1:
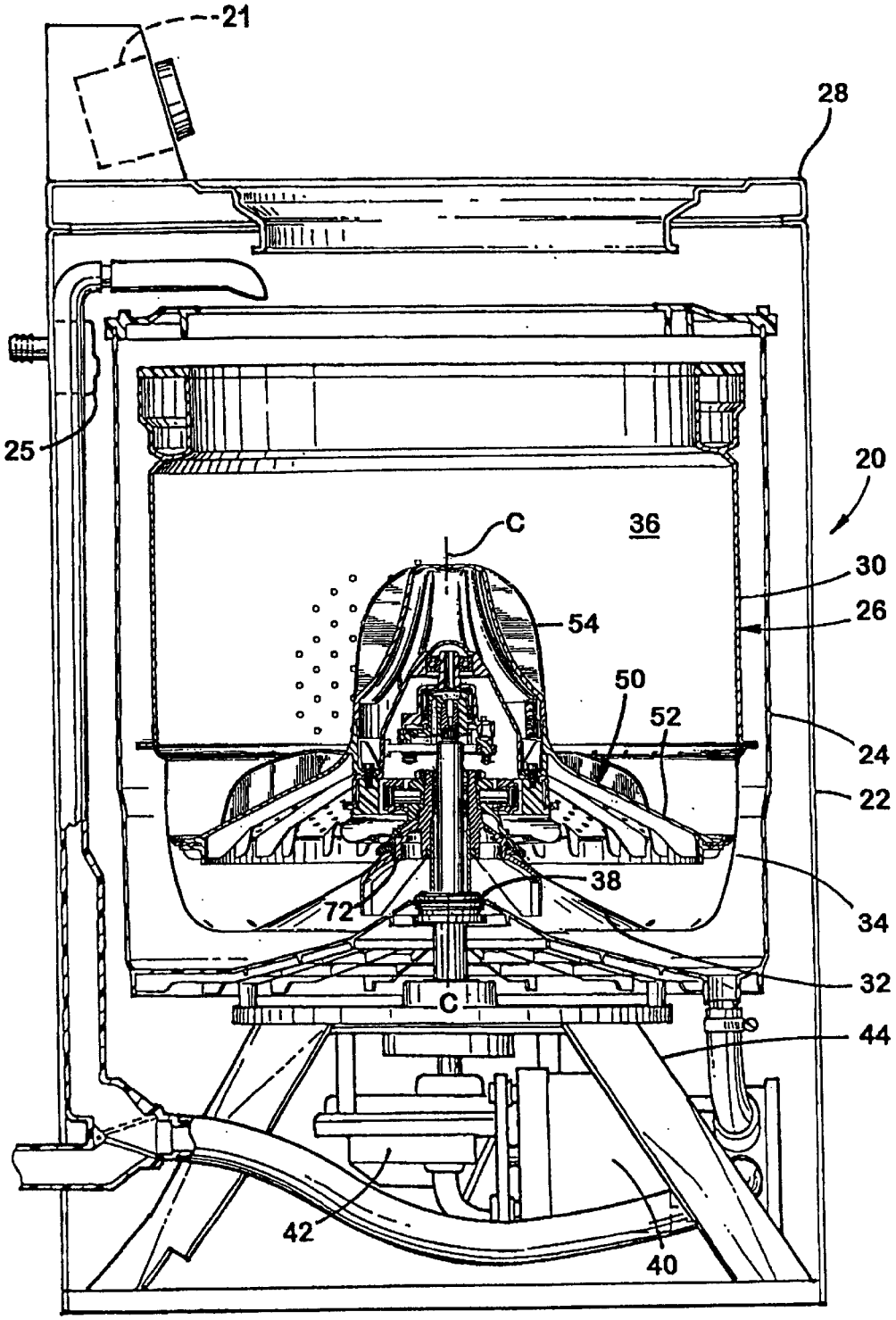
FIG. 1 is a side elevational view, partly in section, of a washing machine alignment system in accordance with the present invention.

In FIG. 1, reference numeral 20 indicates generally a washing machine of the automatic type, i.e., a machine having a pre-settable sequential controller 21 for operating a washer through a pre-selected program of automatic washing, rinsing and drying operations in which the present invention may be embodied. The controller 21 may be an electromechanical timer type device or an electronic microprocessor. The machine 20 includes a frame or cabinet 22 surrounding an imperforate tub 24. A wash basket 26 with perforations or holes is rotatably supported within the tub. A fill valve 25 is connected to an external water supply (not shown) and is operated to inlet water into the tub 24. A hinged lid 28 is provided in the usual manner to provide access to the interior of the wash basket 26.

The wash basket 26 defines a wash chamber 36 and includes a generally cylindrical side wall 30 and a vertical center axis C—C. The side wall 30 includes a partly spherical wall portion 34 adjacent a bottom wall 32. A motor 40 is operatively connected to the basket 26 through a transmission 42 to rotate the basket 26 relative to the stationary tub 24. A suspension frame 44 supports the motor and tub assembly within the cabinet 22. The controller 21 is operatively interconnected with the motor and the fill valve 25 such that the controller 21 can operate the washer 20 according to the selected program cycle.

Positioned within the lower portion of the wash basket 26 is a bottom wash plate 50. The bottom wash plate 50 may be of the type having an annular body 52 and a raised center dome 54. The surface of the wash plate 50 may have vanes or other protrusions.

Figure 2:
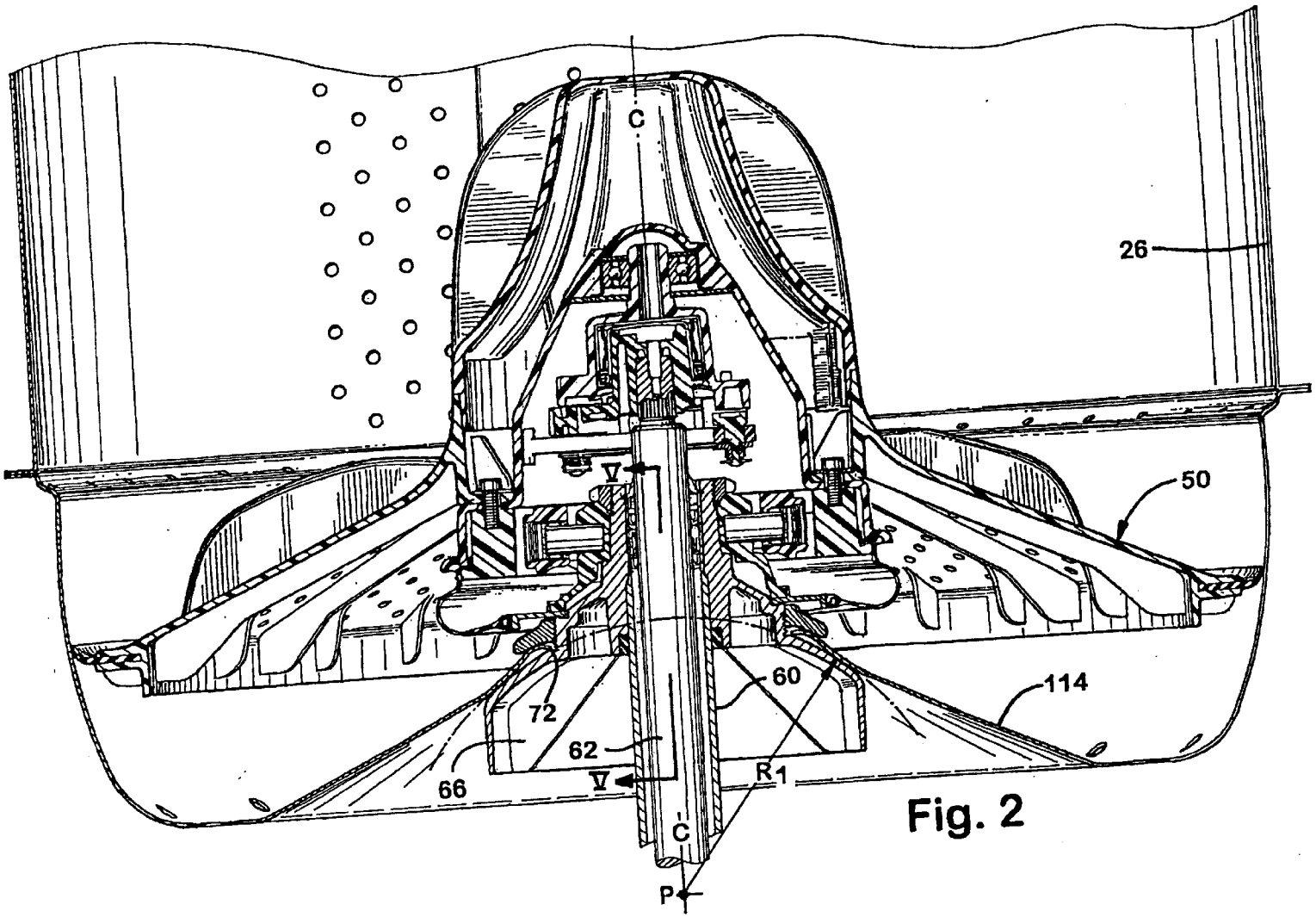
FIG. 2 is a detailed sectional view of a portion of the wash basket and drive block showing the hold down nut in a threaded position.

Turning now to FIG. 2, details of the wash plate drive system may be described. A spin tube 60 is co-axially arranged around an output shaft 62, both of which are drivingly interconnected with the transmission 42. The axes of the spin tube 60 and the output shaft 62 are generally aligned with the center axis C—C. A brake mechanism operates in association with the spin tube 60 and the output shaft 62 for braking the rotation of the spin basket 26. The brake mechanism may be of the type shown in detail in U.S. Pat. No. 4,254,641 to Gauer et al. having the same assignee as the present invention, the disclosure of which is hereby incorporated by reference.

As shown in FIGS. 1 and. 2, the spin tube 60 extends through an aperture 38 in the tub 24 and is attached to the wash basket 26 by a drive block 66. A hold down nut 68 is threaded onto the drive block 66 such that a portion of the wash basket 26 is clamped between the drive block 66 and the hold down nut 68. It can be seen that the aperture 38 in the tub 24 is generally aligned with a central aperture 72 in the wash basket 26 along the center axis C—C.

Figure 3:
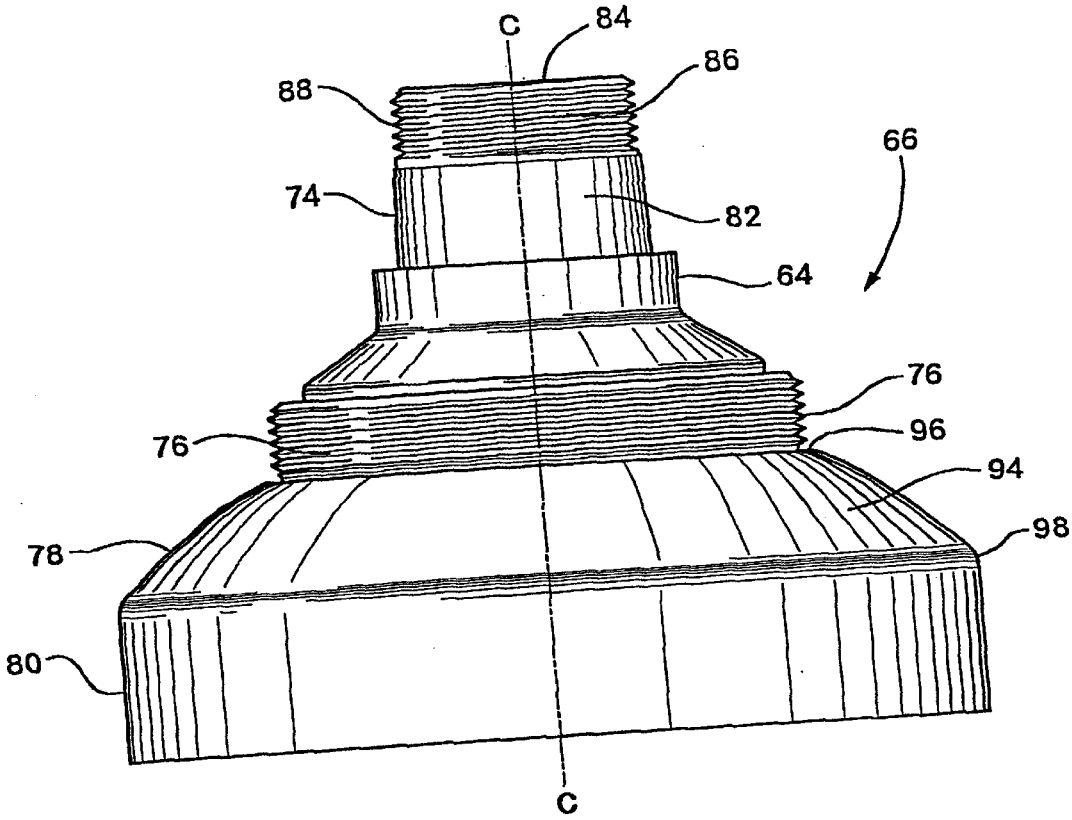
FIG. 3 is a side elevational view of the drive block.

It can be seen in FIGS. 2 and 3 that the drive block 66 has an upper portion 74, a threaded portion 76, a middle portion 78 and a lower portion 80. The threaded portion is positioned between the upper portion and the middle portion. The upper portion 74 comprises a generally tubular portion 82 positioned above a joint assembly area 64 where the wash plate can be mounted to the spin drive tube. There is an aperture 84 extending along the length of the upper portion for receiving the output shaft 62. The aperture 84 is positioned generally along the center axis C—C. The upper portion may have threads 86 positioned along the outside surface 88 of the tubular portion 82 so the drive block upper portion can be threadingly mated with the spin tube, if so desired.

The threaded portion 76 is generally circular and is of a greater diameter than the upper portion 74. The middle portion 78 is generally circular and is of a greater diameter than the threaded portion 76. When the upper portion is inserted from outside the basket, upward and through the wash basket aperture 72, the threaded portion 76 is also inserted through the aperture. The wash basket then abuts the middle portion 78 of the drive block, which remains outside of the wash basket.

Figure 4:
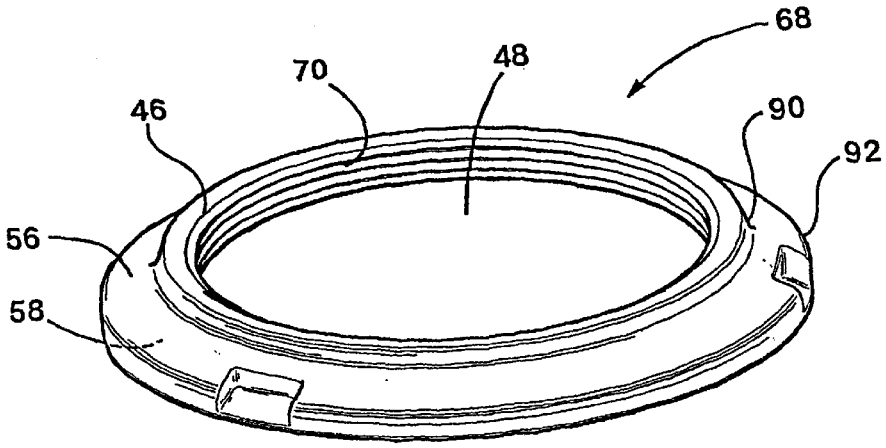
FIG. 4 is a perspective view of the hold down nut.

A hold down nut 68 threadingly engages the threaded portion 76 of the drive block. The nut shown in FIG. 4 has a generally circular circumference 92 and threads 70 positioned along the inner wall 46 of the nut aperture 48. Once the upper portion 74 and the threaded portion 76 of the drive block are inserted into the wash basket aperture 72, the nut 68 can be threaded onto the drive block threaded portion 76, thereby maintaining the wash basket in a position abutting the drive block middle portion 78. It is desirable to align the center axis C—C with the drive block aperture 84 and the wash basket aperture 72 in such a way as to reduce runout when the wash basket is in the spin cycle.

The hold down nut has an upper surface 56 that is positioned toward the interior of the wash basket and an underside surface 58 that is positioned toward the drive block middle portion 78 when the hold down nut is threaded to the drive block. The underside 58 may either be either generally conical or spherical (convex) in shape, sloping downward from a first circumference 90 to a second circumference 92. The first circumference is positioned at the hold down nut threads 70 and is less than the second circumference.

The outside surface 94 of the drive block middle portion 78 is generally spherical in shape with a radius $R_1$ that intersects the center axis C—C at point P as shown in FIG. 2. Therefore, point P is generally the center of the spherical portion of the drive block 66. It can be seen in FIG. 3, that the middle portion has an inner circumference 96 at the juncture of the threaded portion 76 and the middle portion and an outer circumference 98 at the juncture of the middle portion and the lower portion 80. The middle portion of the drive block slopes downward from the inner circumference 96 to the outer circumference 98 with a gently spherical slope providing a generally spherical outside surface area 94 for the middle portion.

Figure 5A:
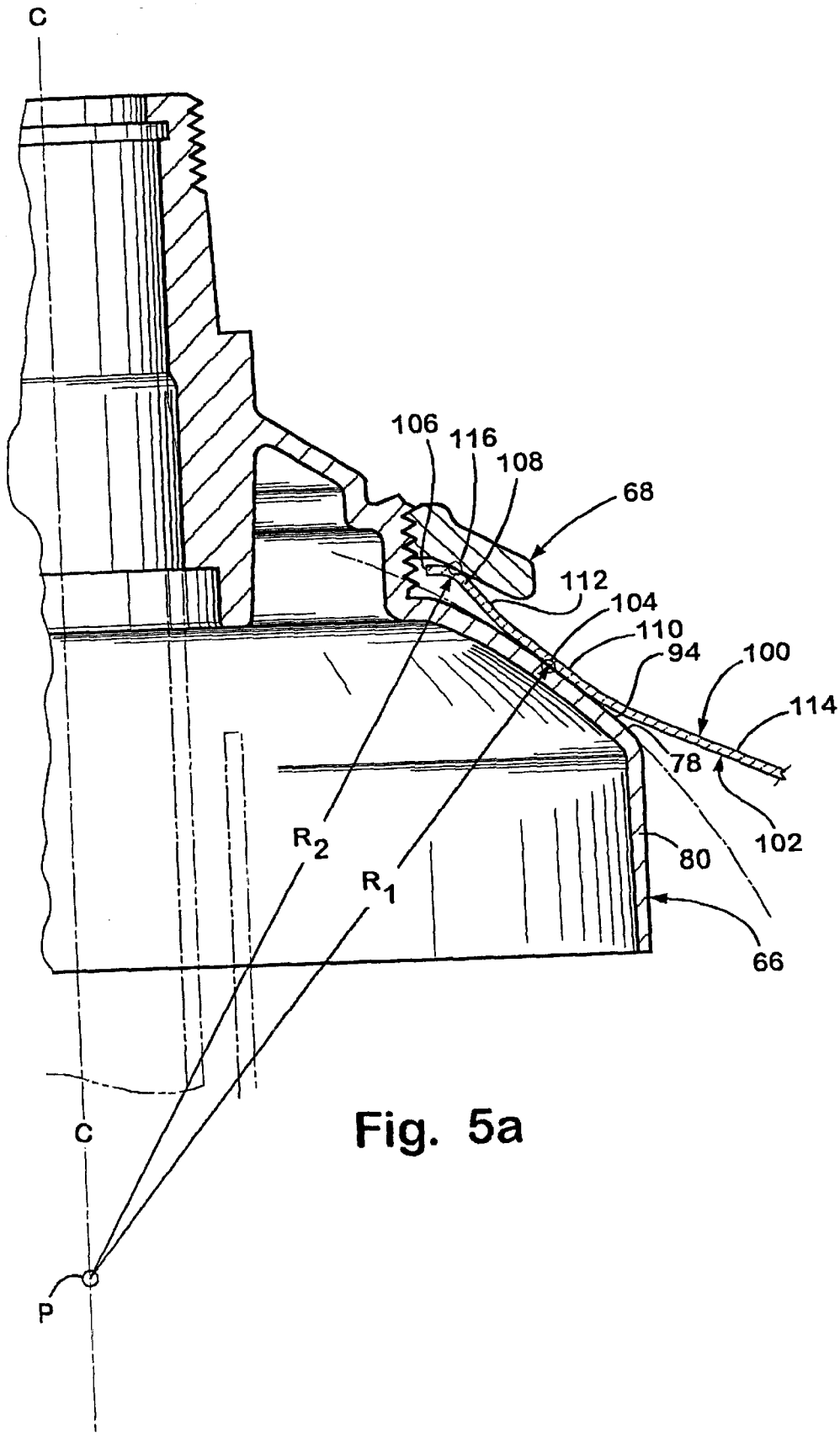
FIG. 5*a* is a view taken along line 5—5 of FIG. 2.
Figure 5B:
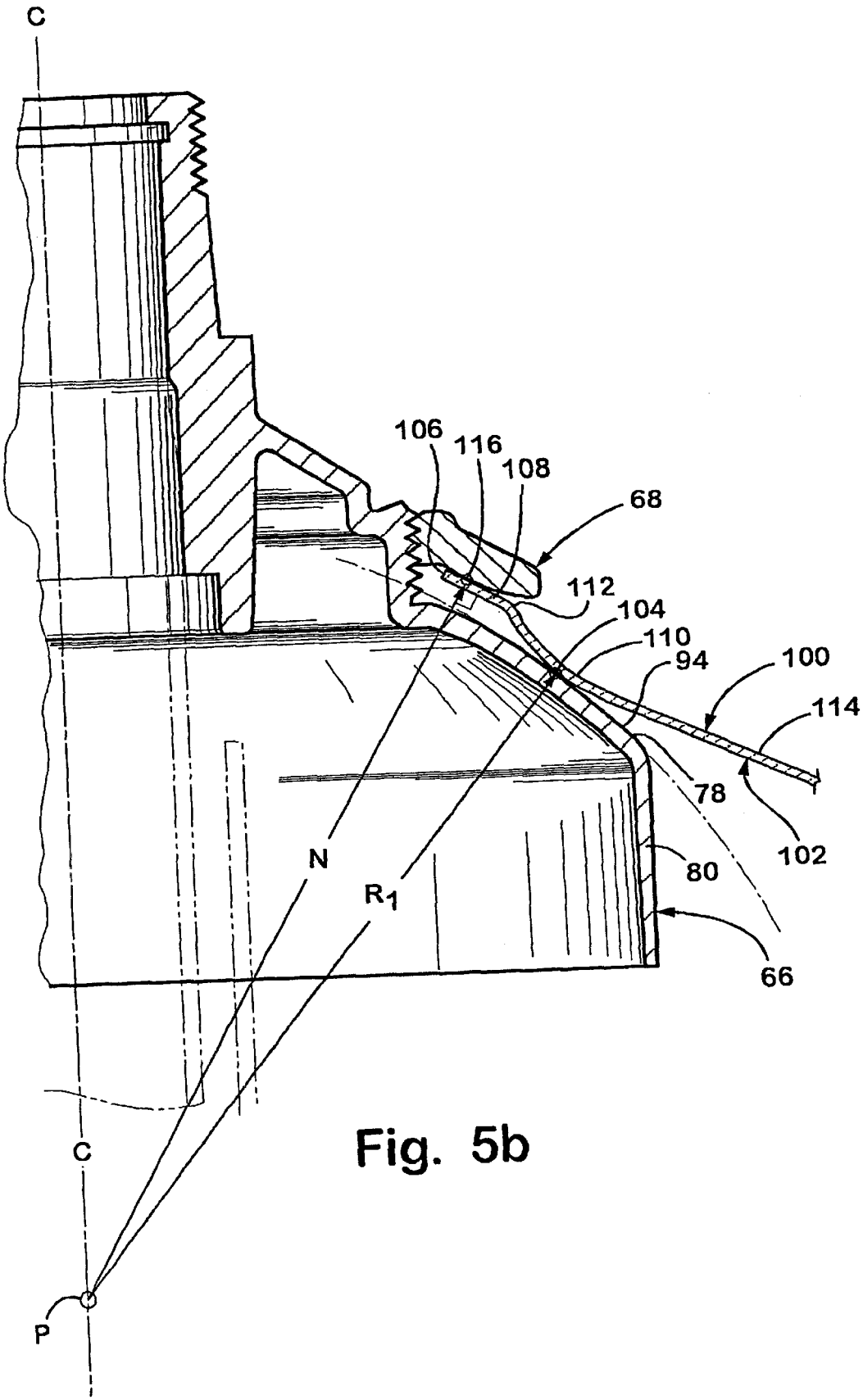
FIG. 5*b* is an alternative embodiment of FIG. 5*a*.

As seen in FIGS. 5*a* and 5*b*, the bottom wall 32 of the wash basket 26 has an inner surface 100 positioned toward the wash chamber 36 and an outer surface 102 positioned toward the drive block 66. A portion of the outer surface 102 abuts the drive block middle portion outside surface 94 when the drive block upper portion 74 and threaded portion 76 are inserted into the wash basket aperture 72. It will be appreciated that the outer basket surface 102 and middle portion 78 abut along a generally circular or elliptical mating juncture 104. The mating juncture is located along the spherical surface 94 thus being at a radius from the center axis C—C generally equal to the radius $R_1$ of the drive block middle portion 78.

The wash basket aperture 72 is generally positioned at the center of the bottom wall 32 of the wash basket. The bottom wall is generally annular and there is a rim 106 defining the circumference of the aperture 72. The bottom wall has a center portion 108 extending outwardly from the rim. The inner surface 100 of the basket's center portion 108 may be either generally conical or spherical (convex) in shape. The center portion extends further outward into a mating portion 110. The outer surface 102 of the basket's mating portion may be either generally conical or spherical (convex) in shape. There may be a bridging portion 112 between the center portion 108 and the mating portion 10 that is of any shape to allow for the transition between the center portion and the mating portion. The bridging portion is shown in FIG. 5*a* as a sloping conical portion and in FIG. 5*b* as a corner that distinguishes the center portion from the mating portion. From the mating portion 110 to the partly spherical wall portion 34 there is an end portion 114. The surfaces of the end portion 114 can be a variety of shapes and slopes so long as it is suitable for allowing a wash plate 50 to be positioned above it. As seen in FIG. 2, the end portion 114 may slope downward from the mating portion 110 then flatten to meet the partly spherical wall portion 34.

Once the upper portion 74 and the threaded portion 76 of the drive block 66 have been inserted into the basket aperture 72, the mating portion 110 of the basket abuts the spherical surface 94 of the drive block middle portion 78. The mating juncture 104 is formed by either a generally spherical or conical shaped mating portion 110 of the basket and the spherical shaped surface of the drive block middle portion 78. The radius of the mating juncture 104 is equal to $R_1$. If the mating portion 110 is conical shaped, then a normal (a perpendicular line) of the mating portion taken at the mating juncture will intersect the center axis C—C at point P. The mating juncture 104 is generally circular or elliptical and substantially concentric with the center axis C—C. Since the mating portion 110 can shift on the spherical shaped drive block middle portion, the basket can be moved into concentric alignment with the center axis C—C so that basket runout is minimized. The combination of either a spherical and spherical surface or a spherical and conical surface abutting at the mating juncture 104 allows the operator to position the basket 26 and the drive block 66 on the spin tube 60, spin the basket, test for basket runout, then shift or alter the mating juncture to reduce basket runout. The drive block radius R1 and the mating juncture normal will still intersect the center axis at point P.

Basically, basket runout is a measure of the overall concentricity of the basket. This measurement may be performed with a simple device that uses a reciprocating pin positioned perpendicular to the outer surface of the side wall of the basket. The distance from the center axis to the device is the desired radius of the basket so the actual radius is measured and adjustments made accordingly. At rest, the pin is at measurement 0. The basket then spins and the pin reciprocates in and out in response to the outer surface of the basket. The difference between the highest number and lowest number is the total basket runout. If the measurement is outside acceptable tolerances, then the wash basket is repositioned for concentric alignment.

As described above, the hold down nut 68 has an underside surface 58 that is generally spherical or conical in shape. When the nut threads 70 are threaded onto the threaded portion 76 of the drive block 66, the underside surface 58 abuts the bottom wall 32 of the wash basket. Since the upper portion 74 and the threaded portion 76 of the drive block are inserted into the aperture 72 of the wash basket, the nut 68 is threaded onto the threaded portion 76 from the interior chamber 36 of the basket, thereby trapping the basket bottom wall 32 between the nut 68 and the drive block middle portion 78. The nut underside surface 58 abuts the bottom wall inner surface 100 at the center portion 108 forming a generally circular or elliptical juncture 116. Thus, the juncture 116 is formed by a conical or spherical (convex) center portion of the basket bottom wall and a spherical or conical underside surface of the nut. In the wash basket alignment system, the combination of the center portion 108 and the underside surface 58 of the nut is either a spherical surface and a spherical surface or a spherical surface and a conical surface; not a conical surface and a conical surface. If the underside of the nut 58 is spherical and the center portion inner surface is spherical or conical, then the radius $R_2$ of the nut underside intersects the center C—C at point P. If the underside of the nut 58 is conical and the center portion 108 is spherical, then the normal N of the nut underside surface taken at juncture 116 intersects the center C—C at point P. The wash basket is aligned about the center axis C—C to reduce basket runout by adjusting the second juncture 116 formed by the hold down nut 68 and wash basket 26 and the mating juncture 104 formed by the wash basket 26 and drive block 66. Since the second juncture 116 comprises either a spherical surface and a conical surface or a spherical surface and a spherical surface, the juncture can be shifted or rolled to allow for concentricity of the wash basket about the center axis. This second juncture 116 is automatically shifted, as the mating juncture 104, which is comprised of the drive block middle portion surface 94 and the outer surface of the wash basket mating portion, is shifted. If a measurement has been taken that indicates basket runout, the mating juncture 104 is shifted to provide a more concentric spinning action of the basket about the center axis C—C. Once an appropriate runout tolerance is reached, the hold down nut 68 can be threadingly tightened. It will be appreciated that the position of the mating juncture generally determines the position of the second juncture 116. The configuration of spherical and spherical and/or conical surfaces at each of the junctures prevents the tightening of the hold down nut from causing the junctures to shift because the radius and normal measurements intersect the center axis C—C at common point P. Thus, the wash basket 26 can be generally aligned about the center axis C—C of the spin tube 66 in such a position as to minimize basket runout. This alignment method allows each basket to be individually aligned concentrically during the manufacturing or assembly process to decrease basket runout.

In the wash basket alignment system, the normal of the conical surfaces and the radius of the spherical surfaces intersect at a common point P on the center axis C—C thus allowing the mating juncture and second juncture to remain in place when the hold down nut is tightened. One method of configuring the wash basket alignment system involves manufacturing the spherical drive block then centering it about the center axis C—C. The radius is measured, thus defining the center point P at which the center axis C—C is intersected. The wash basket is manufactured with a bottom plate having a mating portion 110 that is either conical or spherical along the outer surface 102 and a center portion that is either conical or spherical along the inner surface 100. If the center portion 108 is conical along the inner surface 100, then the underside 58 of the hold down nut will be spherical. If the center portion 108 is spherical along the inner surface 100 then the underside 58 of the hold down nut may be either spherical (convex) or conical in shape. The radius of the spherical surfaces will be manufactured such that the center point P intersects the center axis C—C at the same point P as the drive block radius $R_1$. If the mating juncture and second juncture have a common point P on the center axis C—C (either a radius or normal intersection) then an operator can apply horizontal force to the wash basket to move it from side to side, thus moving the junctures but maintaining the common point P and allowing for concentricity of the wash basket. If the basket runout measurement is outside of acceptable tolerances then this adjustment is made.

It can be seen, therefore, that the present invention provides a system for improving the concentricity of a wash basket to minimized basket runout. While the present invention has been described with reference to the above described embodiments, those of skill in the art will recognize that changes may be made thereto without departing from the scope of the invention as set forth in the appended claims.

We claim:

1. A wash basket alignment system for an automatic washing machine having a wash basket with a bottom wall, said bottom wall having an outer surface and an inner surface, and a spin drive tube extending longitudinally along a generally central axis and through a central aperture in said bottom wall, the system comprising:

a rim defining the bottom wall central aperture, a wash basket center portion extending outward from the rim and being generally spherical in shape along the bottom wall inner surface, a wash basket mating portion extending outward from the center portion and being generally conical in shape along the bottom wall outer surface, and a drive block having an upper portion with a central aperture for receiving the spin drive tube, a middle portion having a generally spherical shaped outside surface, and a threaded portion positioned between the upper portion and the middle portion.

2. The wash basket alignment system according to claim 1, wherein, the drive block middle portion outside surface and the wash basket mating portion outer surface abut at a mating juncture when the drive block upper portion and threaded portion are inserted through the wash basket central aperture.

3. The wash basket alignment system according to claim 2, wherein, the mating juncture is generally circular shaped.

4. The wash basket alignment system according to claim 2, wherein, the mating juncture is generally elliptical shaped.

5. The wash basket alignment system according to claim 2, wherein, the mating juncture is shiftable from a first position with the wash basket not concentric about the central axis to a second position with the wash basket generally concentric about the central axis, and a hold down nut is threadingly engageable with the drive block threaded portion to maintain the second position.

6. The wash basket alignment system according to claim 1, further comprising, a hold down nut having threads and a generally conical shaped underside surface, said threads mating with the drive block threaded portion.

7. The wash basket alignment system according to claim 6, wherein, the hold down nut underside surface and the wash basket center portion inner surface about at a second juncture when the hold down nut threads are threadingly engaged with the drive block threaded portion.

8. The wash basket alignment system according to claim 7, wherein, the second juncture is generally circular shaped.

9. The wash basket alignment system according to claim 7, wherein, the second juncture is generally elliptical shaped.

10. The wash basket alignment system according to claim 1, further comprising, a hold down nut having threads and a generally conical shaped underside surface, said hold down nut positioning the wash basket rim and center portion between the hold down nut and drive block middle portion when the hold down nut is threadingly engaged with the drive block threaded portion.

11. The wash basket alignment system according to claim 10, wherein, said hold down nut positions the mating portion outer surface adjacent the drive block middle portion outside surface when the hold down nut is threadingly engaged with the drive block threaded portion to form a mating juncture.

12. The wash basket alignment system according to claim 11, wherein, the mating juncture moves from a first position when the wash basket is not concentrically aligned about the central axis to a second position when the wash basket is generally concentrically aligned about the central axis.

13. The wash basket alignment system according to claim 12, further comprising, a second juncture at which the wash basket center portion abuts the hold down nut conical shaped underside surface when the hold down nut threads threadingly engage the drive block threaded portion.

14. The wash basket alignment system according to claim 13, wherein, the second juncture is shifted from a first position when the mating juncture is in the first position to a second position when the mating juncture is in the second position, and the second position is maintained by tightening the hold-down nut to the drive block threaded portion.

15. A wash basket alignment system for an automatic washing machine having a wash basket with a bottom wall, said bottom wall having an outer surface and an inner surface, a drive block with a middle portion, said middle portion having a generally spherical outside surface, and a generally central axis extending though a central aperture in said bottom wall and in said drive block, the system comprising:

a point on the central axis defining a radius of the drive block middle portion, a wash basket rim defining the wash basket central aperture, a wash basket center portion extending outward from the rim, said center portion having a generally spherical shaped inner surface, and a point on the central axis defining a radius of the center portion.

16. The wash basket alignment system according to claim 15, wherein:

the center portion point is the drive block point.

17. The wash basket alignment system according to claim 16, further comprising:

a wash basket mating portion extending outward from the center portion and being conical in shape along the bottom wall outer surface, and a mating juncture formed by the drive block middle portion and the mating portion such that a normal of the mating portion taken at the mating juncture passes through the drive block point.

18. The wash basket alignment system according to claim 17, further comprising:

a hold down nut having a generally conical underside surface, and a juncture formed by the center portion inner surface and the hold down nut underside surface such that a normal of the hold down nut underside surface taken at the juncture passes through the drive block point.

19. The wash basket alignment system according to claim 17, further comprising:

a hold down nut having a generally convex underside surface, and a juncture formed by the center portion inner surface and the hold down nut underside surface.

20. The wash basket alignment system according to claim 16, further comprising:

a wash basket mating portion extending outward from the center portion and being spherical in shape along the bottom wall outer surface, and a mating juncture formed by the mating portion and the drive bock middle portion such that the mating juncture is generally at a distance from the drive block point equal to the drive block radius.

21. The wash basket alignment system according to claim 20, further comprising:

a hold down nut having a generally conical underside surface, and a juncture formed by the center portion inner surface and the hold down nut underside surface such that a normal of the hold down nut underside surface taken at the juncture passes through the drive block point.

22. The wash basket alignment system according to claim 20, further comprising:

a hold down nut having a generally convex underside surface, and a juncture formed by the center portion inner surface and the hold down nut underside surface.

23. A wash basket alignment system for an automatic washing machine having a wash basket with a bottom wall, said bottom wall having an outer surface and an inner surface, a drive block with a middle portion, said middle portion having a generally spherical outside surface, and a generally central axis extending though a central aperture in said bottom wall and in said drive block, the system comprising:

a point on the central axis defining a radius of the drive block middle portion, a wash basket rim defining the wash basket central aperture, a wash basket center portion extending outward from the rim, said center portion having a generally conical shaped inner surface.

24. The wash basket alignment system according to claim 23, further comprising:

a wash basket mating portion extending outward from the center portion and being conical in shape along the bottom wall outer surface, and a mating juncture formed by the drive block middle portion and the mating portion such that a normal of the mating portion taken at the mating juncture passes through the drive block point.

25. The wash basket alignment system according to claim 24, further comprising:

a hold down nut having a generally convex underside surface, and a juncture formed by the center portion inner surface and the hold down nut underside surface such that a normal of the center portion taken at the juncture passes through the drive block point.

26. The wash basket alignment system according to claim 23, further comprising:

a wash basket mating portion extending outward from the center portion and being spherical in shape along the bottom wall outer surface, and a mating juncture formed by the mating portion and the drive bock middle portion such that the mating juncture is generally at a distance from the point equal to the drive block radius.

27. The wash basket alignment system according to claim 26, further comprising:

a hold down nut having a generally convex underside surface, and a juncture formed by the center portion inner surface and the hold down nut underside surface such that a normal of the center portion taken at the juncture passes through the drive block point.

* * * * *